US007501918B2

(12) United States Patent
Voss et al.

(10) Patent No.: US 7,501,918 B2
(45) Date of Patent: Mar. 10, 2009

(54) SYSTEM FOR CONNECTING WAVEGUIDES

(75) Inventors: John Daniel Voss, Cumming, GA (US); Terence Newbury, Hoschton, GA (US)

(73) Assignee: EMS Technologies, Inc., Norcross, GA (US)

( * ) Notice: Subject to any disclaimer, the term of this patent is extended or adjusted under 35 U.S.C. 154(b) by 106 days.

(21) Appl. No.: 11/415,319

(22) Filed: May 1, 2006

(65) Prior Publication Data

US 2007/0252665 A1 Nov. 1, 2007

(51) Int. Cl.
*H01P 1/04* (2006.01)

(52) U.S. Cl. ..... 333/254; 333/255

(58) Field of Classification Search ..... 333/254, 333/255

See application file for complete search history.

(56) References Cited

U.S. PATENT DOCUMENTS 3,076,159 A * 1/1963 Vaughan et al. ..... 333/255
3,149,295 A * 9/1964 Grebe ..... 333/254
3,500,264 A * 3/1970 Floyd, Jr. ..... 333/254
3,602,960 A * 9/1971 Urbigkeit et al. ..... 248/74.3
6,499,774 B1 12/2002 Smith

* cited by examiner

*Primary Examiner*—Benny Lee
(74) *Attorney, Agent, or Firm*—King & Spalding LLP

(57) ABSTRACT

A connecting system can couple two waveguides to one another, wherein each of the waveguides comprises a flange or a protruding rim. When the waveguides are connected together, the flanges can face one another in an adjoining arrangement. The connecting system can comprise two members, each having a groove, recess, or slot that receives a circumferential area of the adjoining flanges. The two members can be disposed on opposite lateral sides of the waveguides with each groove embracing a peripheral area of the adjoining flanges. A fastener or another apparatus can bring the two members towards one another, thereby causing the flanges to move deeper into the grooves. That is, the two members can clamp around opposing sides of the flanges. In response to the flanges moving deeper into the grooves, the sidewalls of the grooves can compress the flanges together to attach the waveguides to one another.

10 Claims, 3 Drawing Sheets

SYSTEM FOR CONNECTING WAVEGUIDES

FIELD OF THE INVENTION

The present invention relates to connecting waveguides that transmit electromagnetic energy and more specifically to a system that connects a first piece of flanged waveguide to a second piece of flanged waveguide using a clamping apparatus.

BACKGROUND

Waveguides provide paths for transmitting electromagnetic energy between devices or locations. A waveguide may comprise a hollow tube of metal that guides the electromagnetic energy along a path, for example. Waveguides may also comprise other materials or have other forms according to the wavelength or frequency of the electromagnetic energy. Often, signals modulated on the electromagnetic energy convey information or data along the path of the waveguide.

In many circumstances or applications, two sections or pieces of waveguide are coupled or connected to one another using conventional technologies that exhibit shortcomings. In one such conventional connector technology, a first and a second section of waveguide each has a flange at its adjoining end face. That is, a first and a second flange face one another to provide a contact surface between the two waveguides sections. Screws, typically a set of four screws, passing through the adjoining flanges hold the flanges together. The first flange generally comprises four unthreaded holes drilled there through, wherein the holes run perpendicular to the plane of the first flange and parallel to the longitudinal axis of the first waveguide. The second flange has four aligned holes that are threaded to accept the screws. That is, the second flange has four tapped holes that are located according to the four unthreaded holes of the first flange. The screws are seated in the untapped holes, passing through the first flange, and are fastened into the threads of the second flange. Thus, the screws run through the first flange and engage the threads of the second flange to hold the flanges, and therefore the waveguides, together. In other words, screws that hold the flanges together are conventionally disposed parallel to the longitudinal axis of the waveguides and perpendicular to the plane of the flanges.

One problem with this conventional connector technology is that the locations of the screws in the flanges generally fixes the relative rotational positions of the waveguides. That is, the technology does not readily accommodate rotating one waveguide section with respect to the other waveguide section during assembly. Another shortcoming of this conventional technology is that the orientation of the screws typically restricts access for loosening and tightening the screws. When the waveguides are components of a compact system, such as a communication satellite with cramped working area, an assembler may struggle to properly orient a tool, such as wrench or a screwdriver, to turn the screws.

To address these representative deficiencies in the art, what is needed is an improved capability for mating, connecting, or coupling waveguide sections. Another need exists for a waveguide connector technology that facilitates rotating one waveguide relative to the other waveguide during assembly. A further need exists for a waveguide connector that couples one waveguide to another waveguide using threaded fasteners that are oriented to provide accessibility to assembly personnel and their tools. A capability addressing one or more of these needs would provide a more reliable, flexible, efficient, or compact connection between waveguide sections.

SUMMARY OF THE INVENTION

The present invention supports connecting, coupling, mating, or joining two sections or pieces of waveguide to one another. Each waveguide piece can carry, guide, transmit, or convey signals or electromagnetic ("EM") energy. The energy can comprise microwave energy, millimeter-wave energy, radio waves, radio frequency ("RF") energy, electromagnetic radiation, infrared radiation, visible radiation, light, cellular signals, extremely low frequency ("ELF") signals, super low frequency ("SLF") signals, ultra low frequency ("ULF") signals, very low frequency ("VLF") signals, low frequency ("LF") signals; medium frequency ("MF") signals, high frequency ("HF") signals, very high frequency ("VHF") signals, super high frequency ("SHF") signals, ultra high frequency ("UHF") signals, etc.

In one aspect of the present invention, two pieces of waveguide can connect to one another so that electromagnetic energy or signals can transmit between the waveguide pieces. Each waveguide piece can comprise a flange, a protruding rim, a disk, a washer-shaped structure, or some other salient feature at one end. That is, each waveguide piece can have a flange associated with an end face of that waveguide piece. When the two waveguide pieces are connected together, the two flanges can face one another, contact with one another, butt together, abut, or be adjoining. A clamping apparatus or a holding member can fasten the flanges together or otherwise hold them in relative alignment with one another, thus facilitating the transmission of electromagnetic energy there between. The clamping apparatus can comprise two members or pieces of material, each having a groove, recess, channel, or slot that receives the adjoining flanges. The clamping members can be disposed at two locations around the periphery of the adjoining flanges. The clamping members can be situated on opposing lateral sides of the adjoining flanges, for example. In this configuration, the outer edges of the flanges can be disposed in grooves of the two clamping members. That is, the groove of the first clamping member can embrace a first circumferential portion of the adjoining flanges, and the groove of the second clamping member can embrace a second circumferential portion of the adjoining flanges. A mechanism can move the two clamping members towards one another, thus decreasing the separation between each member. The mechanism can comprise one or more screws, fasteners, attaching devices, or locomoting systems, for example. Moving the clamping members together, for example via tightening the screws, can force the flanges deeper into the grooves. In response to the flanges moving deeper into the grooves, the sides of the grooves can apply force to the flanges to compress the flanges together. That is, when the rims of the flanges move deeper into the grooves, the sides of the grooves can press the flanges together, thereby holding the waveguides pieces together to form the waveguide connection.

The discussion of connecting waveguides presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1:
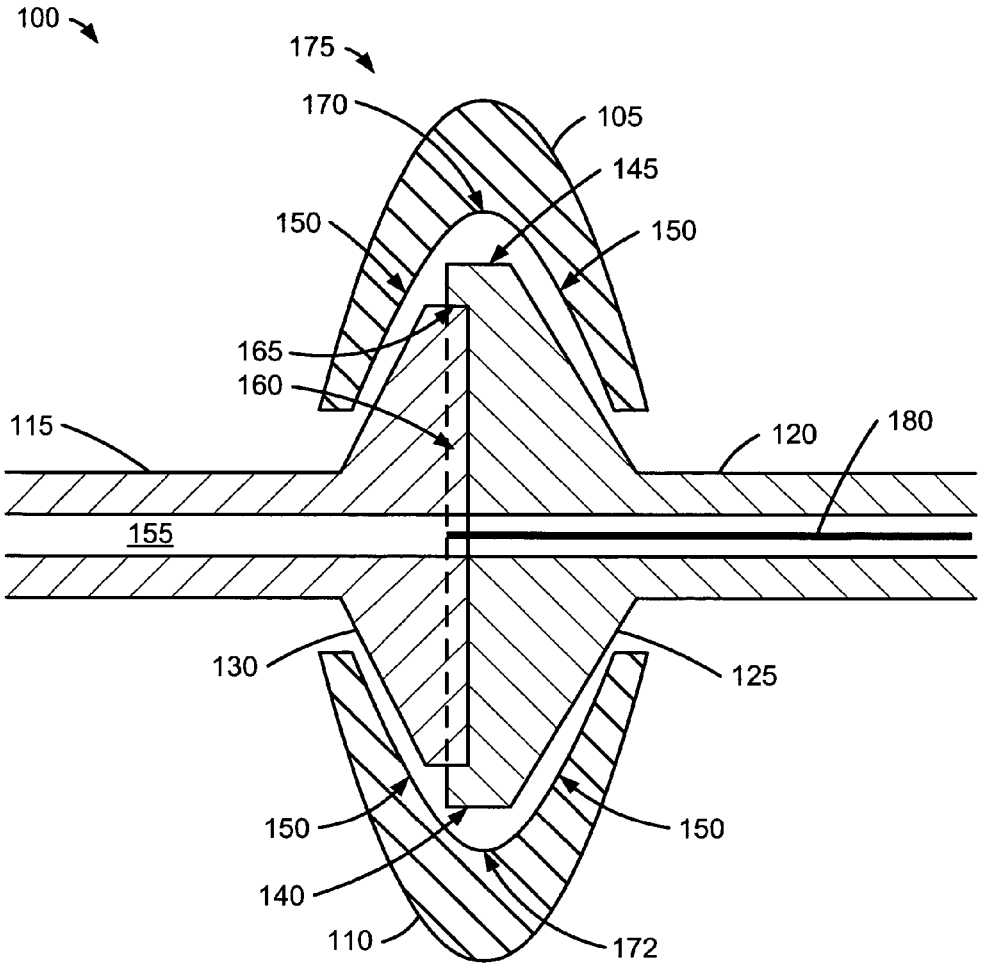
FIG. 1 is a cross-sectional illustration of an exemplary system for connecting waveguides in accordance with an embodiment of the present invention.

Many aspects of the invention can be better understood with reference to the above drawings. The components in the drawings are not necessarily to scale, emphasis instead being placed upon clearly illustrating the principles of exemplary embodiments of the present invention. Moreover, in the drawings, reference numerals designate like or corresponding, but not necessarily identical, elements throughout the several views.

DETAILED DESCRIPTION OF EXEMPLARY EMBODIMENTS

The present invention supports connecting, fastening, joining, or coupling one waveguide to another waveguide. A waveguide connecting system can be readily assembled and/or adjusted in compact devices, such as satellites, that provide little interstitial space to accommodate assembly tools. The connection system can be compact and/or lightweight and can provide manufacturability advantages.

Figure 2:
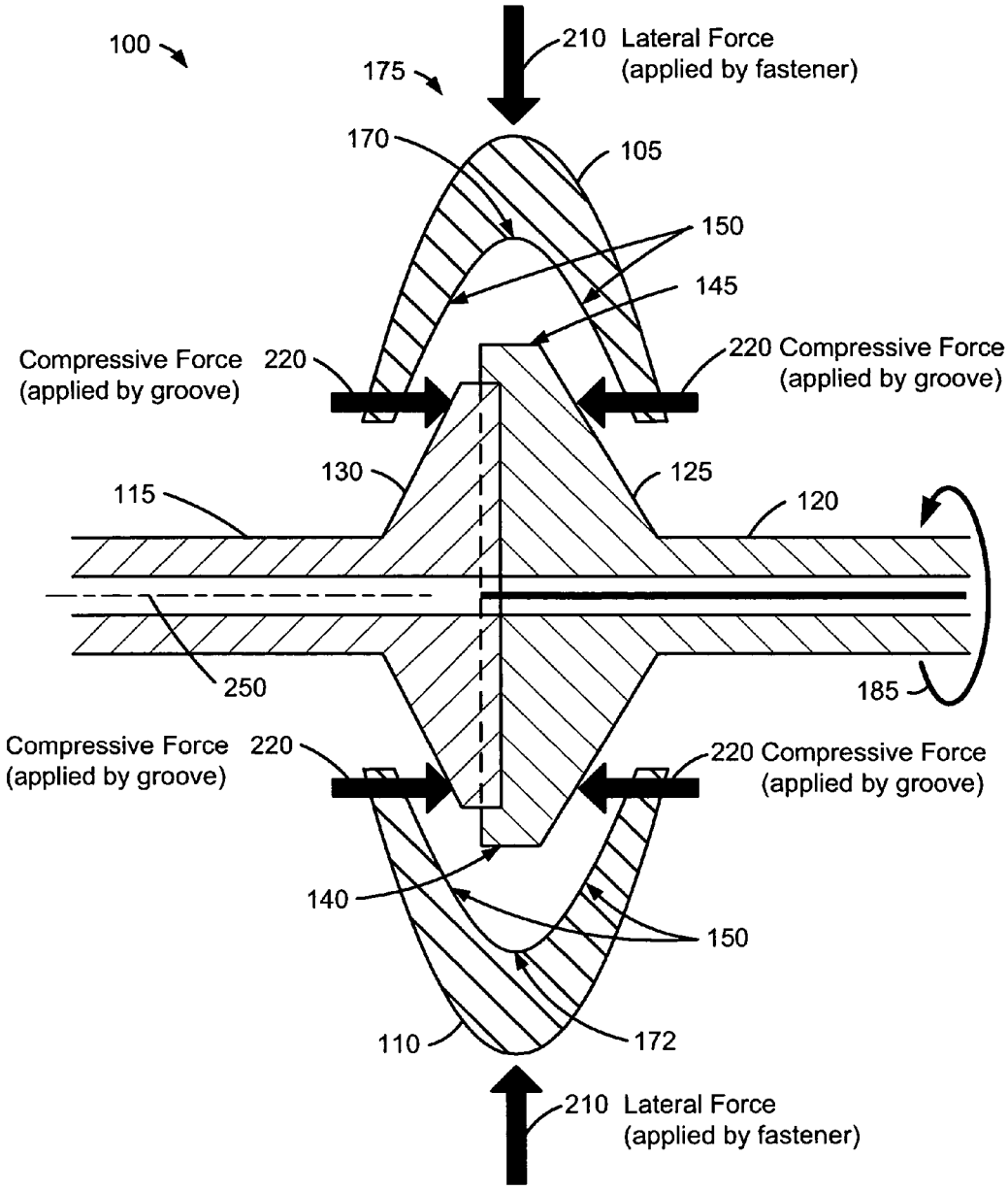
FIG. 2 is an illustration of exemplary assembly and alignment forces associated with a waveguide connector system in accordance with an embodiment of the present invention.
Figure 3:
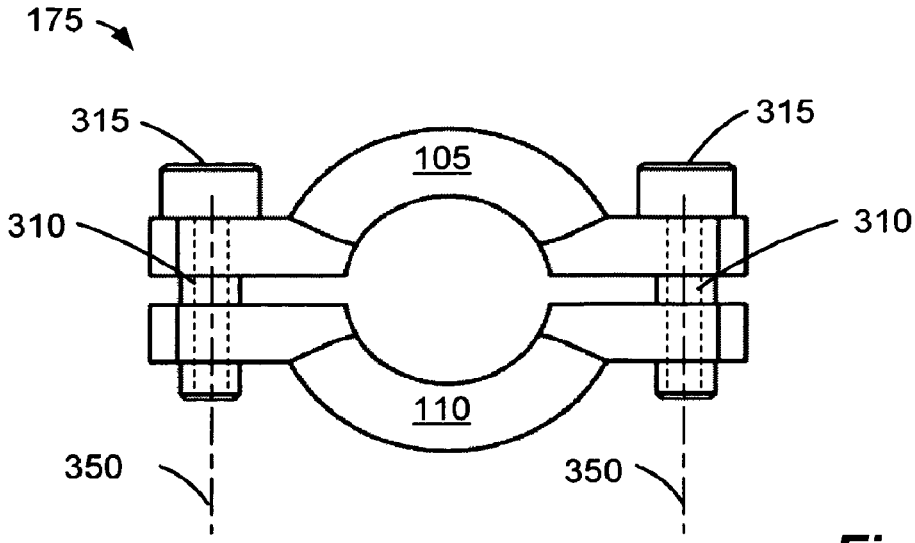
FIG. 3 is an illustration of an exemplary apparatus for connecting two waveguides to one another in accordance with an embodiment of the present invention.
Figure 4:
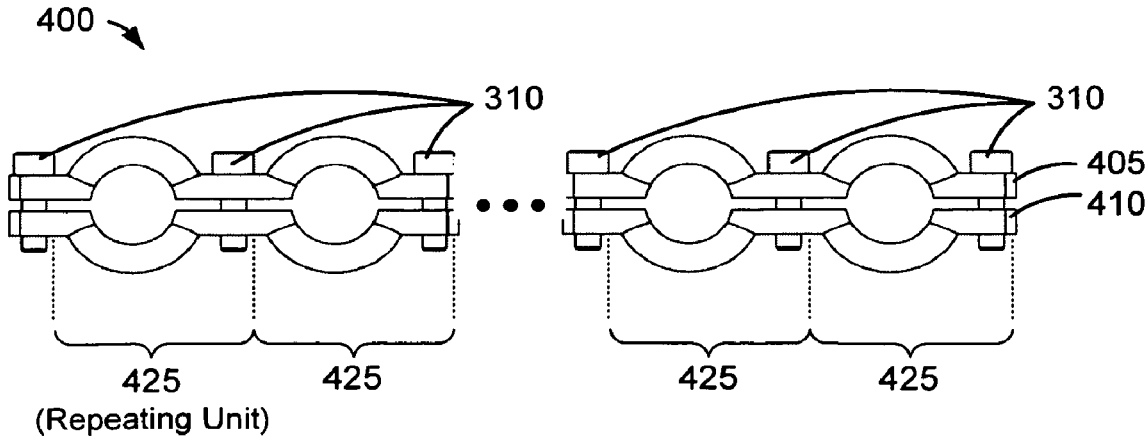
FIG. 4 is an illustration of an exemplary apparatus for connecting a first and a second waveguide to a third and a fourth waveguide in accordance with an embodiment of the present invention.

A system for connecting waveguides will now be described more fully hereinafter with reference to FIGS. 1-4, which show representative embodiments of the present invention. FIGS. 1 and 2 depict cross-sectional views of a waveguide connector and further show a distribution of assembly forces. FIGS. 3 and 4 depict overhead views of waveguide connector clamping devices.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Turning now to FIGS. 1, 2, and 3, these figures illustrate a system 100 for connecting waveguides 115, 120 in accordance with an exemplary embodiment of the present invention as shown in FIGS. 1 and 2. FIG. 1 illustrates a cross-sectional view of the system 100 for connecting waveguides 115, 120 according to one exemplary embodiment of the present invention. FIG. 2 illustrates assembly and alignment forces 210, 220 associated with the waveguide connector system 100 of FIG. 1 according to one exemplary embodiment of the present invention. FIG. 3 illustrates an apparatus 175 for connecting two waveguides 115, 120 to one another according to one exemplary embodiment of the present invention. More specifically, FIG. 3 illustrates an overhead view of the clamping apparatus 175 that FIGS. 1 and 2 illustrate in a cross-sectional format.

The connector system 100 joins, connects, couples, attaches, or otherwise links one section of waveguide 115 to another section of waveguide 120. The waveguides 115, 120 can be hollow tubes or conduits that carry or convey electromagnetic energy, for example transmitting radio frequency signals in a communication system. In one exemplary embodiment, the waveguides 115, 120 support the propagation of electromagnetic energy in the range of 43.5 to 44.5 gigahertz. In one exemplary embodiment, the waveguides 115, 120 can carry electromagnetic signals that have a wavelength of approximately 0.265 inches or 6.73 millimeters.

The waveguides 115, 120 can comprise an opening 155 (FIG. 1) that is cylindrical, square, or circular and that guides the electromagnetic energy, for example. The waveguides 115, 120 can have a composition based on metal or a conductive material, for example. Alternatively, the waveguides can comprise a dielectric material.

As shown in FIGS. 1 and 2, the waveguide 115 has a flange, rim, washer-shaped protrusion, or some other salient feature 130 that faces a corresponding flange, rim, washer-shaped protrusion, or some other salient feature 125 of the waveguide 120. That is, the waveguide 115 has a flange 130 on one end that adjoins or butts to the flange 125 of the waveguide 120. In this manner, the two adjoining flanges 125, 130 provide surfaces for mating and aligning the waveguides 115, 120, one to the other.

The flanges 125, 130 typically exhibit symmetry about the longitudinal axis 250 (FIG. 2) of the respective waveguides 120, 115 to which each is attached. For example, each flange 125, 130 can have the form of a disk or a washer that is centered about the waveguides 120, 115. Alternatively, the flanges 125, 130 can be square, rectangular, oval, or some other form.

Each flange 130, 125 is typically fabricated on a lathe or a metal turning machine and is then attached to the respective waveguide tubing 115, 125 via a brazing, welding, pressing, or gluing operation. Alternatively, the tubing 115, 120 and its associated flange 130, 125 can be formed as a unitary or seamless structure, for example in a mold or via swaging an end of a malleable piece of stock tubing.

In FIG. 1 of the illustrated embodiment, the flange 125 has a recess 165 or a receptacle that receives a portion 160 of the flange 130. That is, the flange 125 comprises a female portion 165 that mates with a male portion 160 of the adjoining flange 130. The mated flanges 125, 130 can comprise a shoulder, a recess, an indentation, a depression, a countersunk region, or a hollowed-out area, for example. In other words, the flange 130 can seat in or with the flange 125.

The seating capability facilitates assembling the system 100 in a cramped environment of a communication system or a satellite, for example. Moreover, the male and female features 160, 165 provide lateral alignment without unnecessarily constraining rotation 185 of the waveguide/flange 125, 130 with respect to the waveguide/flange 120, 125. Thus, a technician that is assembling the satellite can readily rotate 185 (FIG. 2) the waveguide 120 relative to the waveguide 115 until a desired rotational position is achieved.

As illustrated in FIG. 1, the waveguide 120 has an optional reed 180 or a flat strip of metal disposed therein that influences the waveguide's transmission properties according to its relative rotational position. Applying a rotating motion 185 to the waveguide 120 rotates the reed 180 relative to the waveguide 115 as shown in FIG. 2, thereby producing an adjustable change in the electromagnetic energy transmitting there through. For example, the reed 180 can impact polarization, amplitude, or phase.

In one exemplary embodiment a pin (not explicitly shown in the figures) sets or fixes the rotational positions of the waveguide flanges 125, 130, thereby preventing relative rotation 185.

As shown in FIG. 2, the clamping system 175 comprises a first member 105 that is disposed on one lateral side of the adjoining flanges 125, 130 and a second member 110 that is disposed on an opposite lateral side of the adjoining flanges 125, 130. The clamping system 175 can be viewed a device or machine that joins, grips, supports, or compresses the flanges 125, 130. The clamping members 105, 110 can be pieces or components of metal or other materials formed with common fabricating techniques such as machining or molding.

The clamping member 105 embraces a first circumferential portion 145 of the adjoining flanges 125, 130. The clamping member 110 embraces a second circumferential portion 140 of the adjoining flanges 125, 130. More specifically, the clamping member 105 has a groove 170 into which a portion 145 of the adjoining flanges 125, 130 is disposed. Meanwhile, the clamping member 110 has a groove 172 into which another portion 140 of the adjoining flanges 125, 130 is disposed. The grooves 170, 172 can each be or comprise a slot, a recess, an indentation, a channel, a notch, a concave contour, or an inwardly curved surface.

Figure 3A:
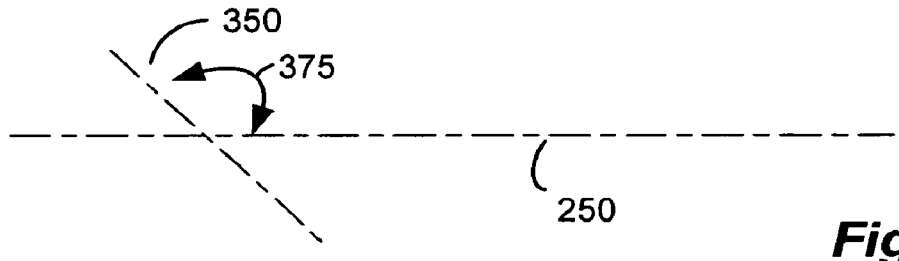

As shown in FIG. 3, the fasteners 310 mechanically link the two clamping members 105, 110 together. As exemplarily illustrated, the fasteners 310 can be bolts, screws, or similar threaded devices. Each of the fasteners 310 has a thread axis 350 that is essentially or approximately perpendicular to the longitudinal axis 250 (FIG. 2) of the coupled waveguides 115, 120. Alternatively, as illustrated in FIG. 3A, the angle 375 between the thread axis 350 and the longitudinal axis 250 (FIG. 2) can be obtuse. The fasteners 310 typically pass through a hole in the clamping member 105 and thread into a threaded hole in the clamping member 110. As a consequence of the fastener orientation, a technician can readily access the heads 315 of the fasteners 310 with a tool, such as a screwdriver, a socket wrench, a spanner, or an open-ended box wrench, to turn the fasteners 310.

Tightening the fasteners 310 applies lateral force 210 (FIG. 2) that moves the clamping member 105 towards the clamping member 110. In other words, when the technician turns the fasteners 310 clockwise (assuming right-hand threads), the clamping members 105, 110 move together. When the clamping members 105, 110 move together, the circumferential area 145 of the adjoining flanges 125, 130 moves deeper into the groove 170 of the clamping member 105. Likewise, tightening the screws 310 pushes (or pulls) the circumferential area 140 of the adjoining flanges 125, 130 into the groove 172 of the clamping member 110.

As the rims of the flanges 125, 130 move into the grooves 170, 172, the groove sidewalls 150 contact and press against the sides of the adjoining flanges 125, 130. Thus, the sidewalls 150 or the concave contours of the grooves 170, 172 apply compressive force 220 to the flanges 125, 130 to move them together into fixed positions.

In other words, tightening the fasteners 310 produces lateral motion and force 210. The flanges 125, 130 receive at least some portion of the lateral force 210. Contact between the groove sidewalls 150 (FIGS. 1 and 2) and the flanges 125, 130 translates the lateral motion and compressive force 210 into longitudinal motion and force 220, as shown in FIG. 2. The longitudinal motion and force 220 presses the flanges 125, 130 together thereby connecting the flange 130 and its associated waveguide 115 to the flange 125 and its associated waveguide 120. Thus, tightening the fasteners 310 couples the waveguides 115, 120 together so that electromagnetic energy can flow efficiently between the waveguides 115, 120.

Turning now to FIG. 4, this figure illustrates an apparatus 400 for connecting a first and a second waveguide to a third and a fourth waveguide according to an exemplary embodiment of the present invention. That is, the figure illustrates a clamping system 400 that couples a first plurality of waveguides to a second plurality of waveguide via two clamping members 405, 410 that function similar to the clamping members 105, 110 discussed above with reference to FIGS. 1, 2 and 3. Where as the clamping members 105, 110 embrace a pair of adjoining flanges 125, 130, the clamping members 405, 410 embrace multiple pairs of adjoining flanges (not explicitly depicted in FIG. 4).

The clamping system 400 comprises a repeating connection unit 425, with each unit 425 coupling one waveguide to another waveguide. The number of repeating connection units 425 determines the number of flanged waveguides that the system 400 can connect together. In this manner, the system 400 can be extended to handle arrays of flanged waveguides, with an arbitrary number of waveguides in each array.

The clamping member 405 is typically a unitary or seamless component, for example machined from a single piece of metal or plastic stock. Likewise, the clamping member 410 is typically fabricated from one piece of stock. Fasteners 310 join the first clamping member 405 to the second clamping member 410. The clamping members 405, 410 have grooves (not explicated depicted in FIG. 4) into which waveguide flanges are disposed. Tightening the fasteners 310 moves the clamping members 405, 410 together. As discussed above with reference to FIGS. 1, 2, and 3, moving the clamping members 405, 410 together presses the rims of the waveguide flanges into the grooves, thereby forcing the flanges together and connecting a first waveguide array to a second waveguide array.

In summary, an exemplary embodiment of the present invention can couple a first conduit for carrying electromagnetic energy to a second conduit for carrying electromagnetic energy in a manner that promotes efficient energy transfer and that facilitates waveguide assembly and adjustment.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. An apparatus, for connecting a first waveguide having a first flange to a second waveguide having a second flange, comprising:

a first member comprising a first groove that embraces first circumferential portions of the first flange and the second flange; and a second member, comprising a second groove that embraces second circumferential portions of the first flange and the second flange, mechanically coupled to the first member via a fastener having a thread axis disposed at an angle with respect to a longitudinal axis of the first waveguide, wherein the angle is an obtuse angle.

2. The apparatus of claim 1, wherein:

the fastener is operative to urge the first member towards the second member in response to rotation about the thread axis; and the first groove and the second groove are operative to urge the first flange towards the second flange in response to the fastener urging the first member towards the second member.

3. The apparatus of claim 1, wherein the fastener comprises a bolt.

4. The apparatus of claim 1, further comprising a second fastener disposed through a first hole in the first member and a second hole in the second member.

5. The apparatus of claim 1, wherein the fastener comprises a screw.

6. An apparatus, for connecting a first waveguide having a first flange to a second waveguide having a second flange, comprising:

a first member comprising a first groove that embraces first circumferential portions of the first flange and the second flange; and a second member, comprising a second groove that embraces second circumferential portions of the first flange and the second flange, mechanically coupled to the first member via a fastener having a thread axis disposed at an angle with respect to a longitudinal axis of the first waveguide, wherein the apparatus is further for connecting a third waveguide having a third flange to a fourth waveguide having a fourth flange, wherein the first member further comprises a third groove that embraces third circumferential portions of the third flange and the fourth flange, and wherein the second member further comprises a fourth groove that embraces fourth circumferential portions of the third flange and the fourth flange.

7. A system for connecting a first section of waveguide, comprising a first protruding rim at a first end, to a second section of waveguide, comprising a second protruding rim at a second end, the system comprising:

a first member, comprising a first channel for receiving a first periphery area of the first and the second protruding rims from a first lateral side of the first section of waveguide;

a second member, comprising a second channel for receiving a second periphery area of the first and the second protruding rims from a second lateral side of the first section of waveguide; and a mechanism, connecting the first member to the second member, operative to decrease lateral separation between the first member and the second member, wherein the first channel and the second channel are operative to apply compression force between the first protruding rim and the second protruding rim in response to the decrease in lateral separation, wherein the mechanism comprises a fastener, wherein the first section of waveguide has a longitudinal axis, wherein the fastener has an axis of rotation, and wherein the axis of rotation is oriented at an obtuse angle with respect to the longitudinal axis.

8. The system of claim 7, wherein the mechanism comprises a screw disposed through a hole in at least one of the first member and the second member.

9. The system of claim 7, wherein the first channel comprises a first groove and wherein the second channel comprises a second groove.

10. A system for connecting a first section of waveguide, comprising a first protruding rim at a first end, to a second section of waveguide, comprising a second protruding rim at a second end, the system comprising:

a first member, comprising a first channel for receiving a first periphery area of the first and the second protruding rims from a first lateral side of the first section of waveguide;

a second member, comprising a second channel for receiving a second periphery area of the first and the second protruding rims from a second lateral side of the first section of waveguide; and a mechanism, connecting the first member to the second member, operative to decrease lateral separation between the first member and the second member, wherein the first channel and the second channel are operative to apply compression force between the first protruding rim and the second protruding rim in response to the decrease in lateral separation, wherein:

the first member further comprises a third channel, adjacent the first channel, for receiving a first portion of a third protruding rim of a third section of waveguide;

the second member further comprises a fourth channel, adjacent the second channel, for receiving a second portion of a fourth protruding rim of a fourth section of waveguide; and wherein the system is operative to connect the third section of waveguide to the fourth section of waveguide.

* * * * *